US011662681B2

(12) United States Patent
Umenai et al.

(10) Patent No.: US 11,662,681 B2
(45) Date of Patent: May 30, 2023

(54) IMAGE FORMING APPARATUS AND MOVEMENT AMOUNT DETECTION DEVICE

(71) Applicant: FUJIFILM BUSINESS INNOVATION CORP., Tokyo (JP)

(72) Inventors: Ko Umenai, Kanagawa (JP); Satoshi Ezawa, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/539,823

(22) Filed: Dec. 1, 2021

(65) Prior Publication Data

US 2023/0060975 A1 Mar. 2, 2023

(30) Foreign Application Priority Data

Aug. 25, 2021 (JP) ..... JP2021-137626

(51) Int. Cl.
*G03G 15/00* (2006.01)

(52) U.S. Cl.
CPC ..... *G03G 15/50* (2013.01)

(58) Field of Classification Search
CPC ..... G03G 15/50; G03G 2215/00143; G03G 2215/00156
See application file for complete search history.

(56) References Cited

U.S. PATENT DOCUMENTS

2006/0289280 A1* 12/2006 Furuya ..... G03G 15/1615 198/806
2007/0144871 A1* 6/2007 Tao ..... G03G 15/1615 198/806
2008/0112714 A1* 5/2008 Fujihara ..... G03G 15/50 356/614
2008/0240802 A1* 10/2008 Nakura ..... G03G 15/1605 474/70
2011/0110691 A1* 5/2011 Hirose ..... G03G 15/0131 399/302
2011/0123237 A1* 5/2011 Kudo ..... G03G 15/1615 399/313

FOREIGN PATENT DOCUMENTS

JP 2010-256789 A 11/2010

* cited by examiner

*Primary Examiner* — Sandra Brase
(74) *Attorney, Agent, or Firm* — Oliff PLC

(57) ABSTRACT

An image forming apparatus includes: a belt to be transported; an image forming body that forms an image on the belt or a recording medium that is transported by the belt; a moving mechanism that moves the belt in a movement direction extending in a thickness direction of the belt; a rotational member including a rotation shaft extending in the movement direction and a contact portion that is rotatable around the rotation shaft and that is in contact with a side surface of the belt regardless of a position of the belt in the movement direction; an acquirer that acquires a physical amount that changes due to rotation of the contact portion around the rotation shaft when the belt moves in a width direction; and a detector that detects a movement amount of the belt in the width direction based on the physical amount acquired by the acquirer.

19 Claims, 7 Drawing Sheets

IMAGE FORMING APPARATUS AND MOVEMENT AMOUNT DETECTION DEVICE

CROSS-REFERENCE TO RELATED APPLICATIONS

This application is based on and claims priority under 35 USC 119 from Japanese Patent Application No. 2021-137626 filed Aug. 25, 2021.

BACKGROUND

(i) Technical Field

The present disclosure relates to an image forming apparatus and a movement amount detection device.

(ii) Related Art

Japanese Unexamined Patent Application Publication No. 2010-256789 discloses a belt meandering amount measurement device that measures a meandering amount of an endless belt that is wound around multiple rollers and rotated. In this belt meandering amount measurement device, a measurement reference portion extending in a rotating direction of a belt and having a predetermined length, a first measurement unit extending parallel in the rotating direction of the belt while being shifted from the measurement reference portion in a width direction of the belt, and a second measurement unit extending parallel in the rotating direction of the belt while being shifted from the measurement reference portion and the first measurement unit in the width direction of the belt are formed at one side end portion in the width direction of the belt. A sensor that outputs voltages in accordance with positions of the measurement reference portion, the first measurement unit, and the second measurement unit in the width direction of the belt is disposed near the one side end portion in the width direction of the belt. As pre-use data setting of the belt, in a state in which the belt rotates without meandering, voltages at the positions of the measurement reference portion, the first measurement unit, and the second measurement unit are measured with the measurement reference portion serving as a reference position. A conversion expression representing a relationship between the measurement result and distances of the first measurement unit and the second measurement unit from the reference position in the width direction of the belt is obtained. When the belt is used, the sensor measures a voltage at a predetermined interval at any position of the measurement reference portion, the first measurement unit, and the second measurement unit, converts the voltage into a distance from the reference position in the width direction of the belt by the conversion expression, and obtains a difference of the distance from the reference position obtained at the predetermined interval to measure a meandering amount of the belt.

SUMMARY

There is an image forming apparatus in which an image forming body that forms an image on a belt and a moving mechanism that moves the belt in a thickness direction thereof are provided in the vicinity of the transported belt. Further, in this image forming apparatus, a rotational member that is rotatable around a rotation shaft in a transport direction of the belt is brought into contact with a side surface of the belt, and a movement amount of the belt in a width direction is detected based on a physical amount that changes in accordance with a rotation angle of the rotational member.

In this image forming apparatus, when the position of the belt in the thickness direction changes, the rotation angle of the rotational member per unit movement amount in the width direction of the belt changes. Thus, this image forming apparatus is not able to accurately detect the movement amount in the width direction of the belt whose position in the thickness direction changes.

Aspects of non-limiting embodiments of the present disclosure relate to accurately detecting a movement amount in a width direction of a belt whose position in a thickness direction changes, as compared with a case where a movement amount in a width direction of a belt is detected based on a physical amount that changes due to rotation of a rotational member that is rotatable around a rotation shaft in a transport direction of the belt.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus including: a belt to be transported; an image forming body that forms an image on the belt or a recording medium that is transported by the belt; a moving mechanism that moves the belt in a movement direction extending in a thickness direction of the belt; a rotational member including a rotation shaft extending in the movement direction and a contact portion that is rotatable around the rotation shaft and that is in contact with a side surface of the belt regardless of a position of the belt in the movement direction; an acquirer that acquires a physical amount that changes due to rotation of the contact portion around the rotation shaft when the belt moves in a width direction; and a detector that detects a movement amount of the belt in the width direction based on the physical amount acquired by the acquirer.

BRIEF DESCRIPTION OF THE DRAWINGS

An exemplary embodiment of the present disclosure will be described in detail based on the following figures, wherein.

DETAILED DESCRIPTION

Hereinafter, an exemplary embodiment according to the disclosure will be described in detail with reference to the drawings. Hereinafter, an upstream side in a transport direction of recording paper P as an example of a recording medium may be simply referred to as an "upstream side", and a downstream side in the transport direction may be simply referred to as a "downstream side". Similarly, an upstream side in a circling direction of a transfer belt (belt) (formation target body) 52 may be simply referred to as an "upstream side", and a downstream side in the circling direction (transport direction) may be simply referred to as a "downstream side". In the following description, a reference position of the "upstream side" and the "downstream side" of the transfer belt is a second transfer position T2 (nip region Np) described later. That is, a direction from the second transfer position T2 toward a pressing roller 49 after passing through a driving roller 44 is the "downstream side" of the transfer belt, and a direction from the second transfer position T2 toward a second photoreceptor unit 30K after passing through a retract roller 47 is the "upstream side" of the transfer belt.

Figure 1:
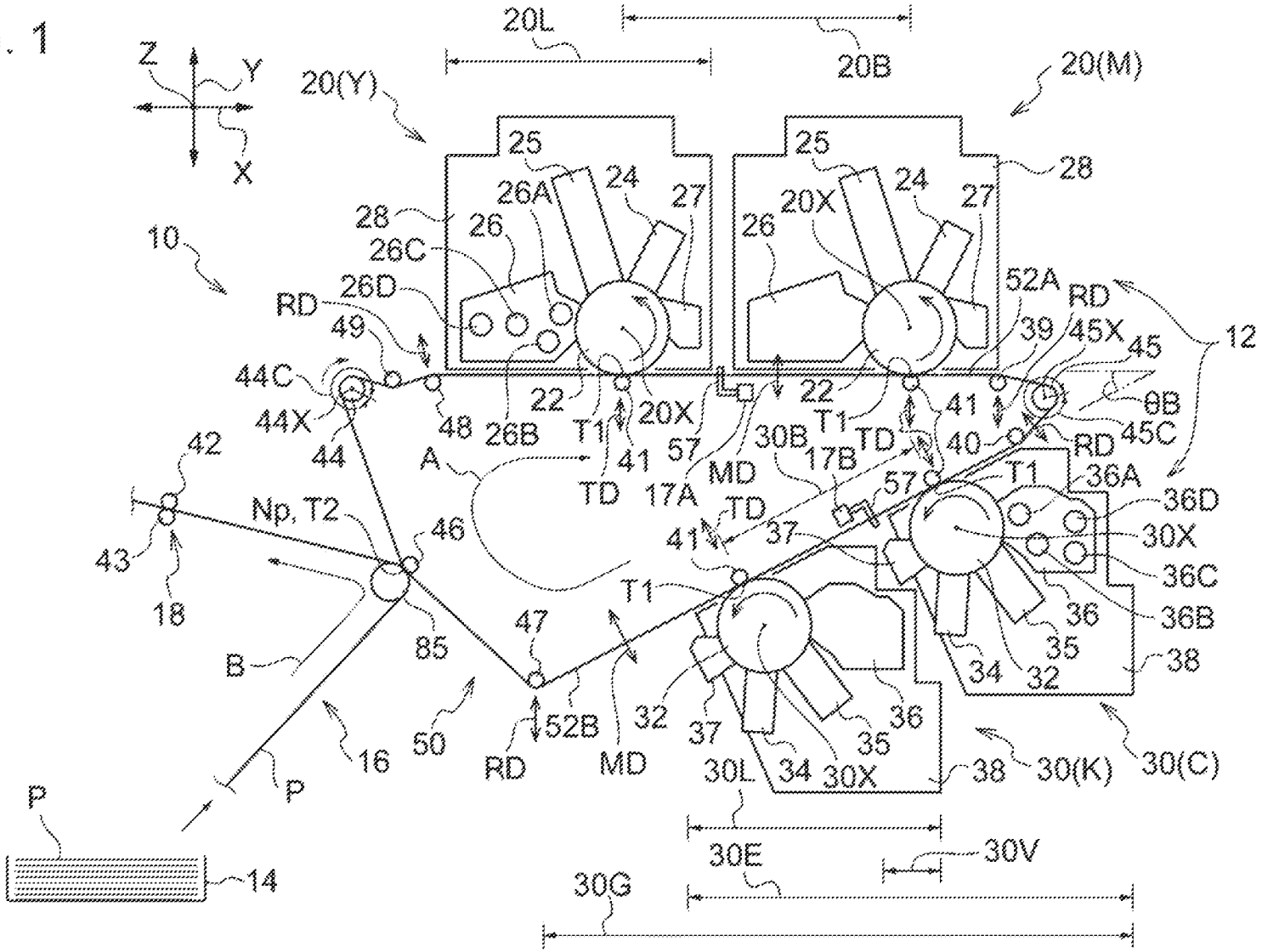
FIG. 1 is a general configuration diagram illustrating an image forming apparatus according to a present exemplary embodiment.

As illustrated in FIG. 1, an image forming apparatus 10 according to the present exemplary embodiment is of an electrophotographic system that forms a toner image (an example of an image) on recording paper P. The image forming apparatus 10 includes an image forming section 12, a storage section 14, a transport section 16, and a fixing device 18 in an apparatus body (not illustrated). Hereinafter, each component of the image forming apparatus 10 will be described.

In the following description, a width direction (horizontal direction) of the apparatus body is defined as an X direction, an up-down direction (vertical direction) of the apparatus body is defined as a Y direction, and a front-rear direction (a direction orthogonal to a paper surface) orthogonal to the X direction and the Y direction is defined as a Z direction. In FIG. 1, the near side of the paper surface is a front side, and the far side of the paper surface is a rear side.

Image Forming Section

The image forming section 12 has a function of forming a toner image on recording paper P. The image forming section 12 includes a first photoreceptor unit 20, a second photoreceptor unit 30, and a transfer device 50.

Photoreceptor Units

As illustrated in FIG. 1, two first photoreceptor units 20 and two second photoreceptor units 30 are provided. Each first photoreceptor unit 20 and each second photoreceptor unit 30 are attachable to and detachable from the apparatus body. The image forming apparatus 10 includes first photoreceptor units 20Y and 20M for yellow (Y) and magenta (M) and second photoreceptor units 30C and 30K for cyan (C) and black (K).

In the following description, in a case where it is necessary to distinguish each color of yellow (Y), magenta (M), cyan (C), or black (K), an alphabet of Y, M, C, or K is added after a reference numeral of each member. In a case where it is not necessary to distinguish each color, an alphabet of Y, M, C, or K may be omitted.

The transfer belt 52 made of an elastic material of the transfer device 50 described later includes two straight portions that are straight-line shaped when viewed in the Z direction. The two straight portions are an upper portion 52A and a lower portion 52B. When viewed in the Z direction, the upper portion 52A extends in the X direction, and the lower portion 52B is inclined with respect to the X direction. That is, when viewed in the Z direction, an angle θB (see FIG. 1) defined by the lower portion 52B and the X direction is an acute angle, and the angle θB is larger than an angle θA (not illustrated) defined by the upper portion 52A and the X direction. Note that the angle θA is 0° or an acute angle slightly larger than 0°. When viewed in the Z direction, the upper portion 52A and the lower portion 52B are mutually arranged in the Y direction. The "straight portion" in the present specification and claims is not limited to a completely straight-line-shaped portion. For example, in the upper portion 52A located between a retract roller 39 and a retract roller 48 described later, portions pressed by the two first photoreceptor drums 22 and first transfer rollers 41 are slightly recessed; however, the upper portion 52A corresponds to the "straight portion". Similarly, in the lower portion 52B located between a retract roller 40 and the retract roller 47, portions pressed by the two second photoreceptor drums 32 and first transfer rollers 41 are slightly recessed; however, the lower portion 52B corresponds to the "straight portion". A width direction of the transfer belt 52 extends in the Z direction.

The two first photoreceptor units 20 face an outer peripheral surface (upper surface) of the upper portion 52A and are arranged in the X direction along the upper portion 52A. Each first photoreceptor unit 20 includes the first photoreceptor drum 22 that rotates in one direction (for example, the counterclockwise direction in FIG. 1). Each first photoreceptor drum 22 is rotatable around a rotation axis 20X extending in the Z direction. Each first photoreceptor unit 20 includes a first charging portion 24, a first exposure portion 25, a first developing portion 26, and a first removing portion 27 in this order from the upstream side in the rotation direction of the first photoreceptor drum 22. Each first photoreceptor unit 20 further includes a pair of support plates 28 separated from each other in the Z direction. One of the support plates 28 is not illustrated in FIG. 1. The first charging portion 24, the first exposure portion 25, the first developing portion 26, and the first removing portion 27 are members extending in the Z direction. Both end portions of the first charging portion 24, the first exposure portion 25, the first developing portion 26, and the first removing portion 27 in the Z direction are supported by the pair of support plates 28. Further, relative movement of the pair of support plates 28 is restricted. As illustrated in FIG. 1, the dimension of each first photoreceptor unit 20 in the X direction is a horizontal dimension 20L.

The two second photoreceptor units 30 face an outer peripheral surface (lower surface) of the lower portion 52B and are arranged along the lower portion 52B. Each second photoreceptor unit 30 includes a second photoreceptor drum 32 that rotates in one direction (for example, the counterclockwise direction in FIG. 1). Each second photoreceptor drum 32 is rotatable around a rotation axis 30X extending in the Z direction. Each second photoreceptor unit 30 includes a second charging portion 34, a second exposure portion 35, a second developing portion 36, and a second removing portion 37 in this order from the upstream side in the rotation direction of the second photoreceptor drum 32. Each second photoreceptor unit 30 further includes a pair of second support plates 38 separated from each other in the Z direction. One of the second support plates 38 is not illustrated in FIG. 1. The second charging portion 34, the second exposure portion 35, the second developing portion 36, and the second removing portion 37 are members extending in the Z direction. Both end portions of the second charging portion 34, the second exposure portion 35, the second developing portion 36, and the second removing portion 37 in the Z direction are supported by the pair of second support plates 38. Further, relative movement of the pair of second support plates 38 is restricted. As illustrated in FIG. 1, the dimension of each second photoreceptor unit 30 in the X direction is a horizontal dimension 30L.

In the present specification and claims, a term "image forming body" refers to a body that causes toner or ink to adhere to a formation target body (for example, the transfer belt 52). That is, the first photoreceptor drum 22 of the first photoreceptor unit 20 corresponds to the "image forming body", and the second photoreceptor drum 32 of the second photoreceptor unit 30 corresponds to the "image forming body". That is, the first charging portion 24, the first exposure portion 25, the first developing portion 26, and the first removing portion 27 do not correspond to the "image forming body". Similarly, the second charging portion 34, the second exposure portion 35, the second developing portion 36, and the second removing portion 37 do not correspond to the "image forming body". As will be described later, when the image forming apparatus 10 is of an inkjet type, an inkjet head corresponds to the "image forming body".

A first distance 20B is a distance (adjacent distance) between two portions on which images are formed by the two first photoreceptor drums 22 or two inkjet heads on the outer peripheral surface of the upper portion 52A when viewed in the Z direction. When the first photoreceptor drums 22 correspond to the "image forming bodies", two line segments connecting the first photoreceptor drums 22 and the first transfer rollers 41 respectively corresponding to the first photoreceptor drums 22 intersect with the outer peripheral surface of the upper portion 52A at two intersection portions of the outer peripheral surface. When the first photoreceptor drums 22 correspond to the "image forming bodies", the first distance 20B is a distance between the two intersection portions when viewed in the Z direction. When the image forming apparatus 10 is of an inkjet type, the first distance 20B is a distance between center portions of inkjet heads (image forming bodies) corresponding to the first photoreceptor units 20.

Further, a second distance 30B is a distance between two portions of the outer peripheral surface of the lower portion 52B on which images are formed by the two second photoreceptor units 30 or two inkjet heads when viewed in the Z direction. When the second photoreceptor drums 32 correspond to the "image forming bodies", two line segments connecting the second photoreceptor drums 32 and the first transfer rollers 41 respectively corresponding to the second photoreceptor drums 32 intersect with the outer peripheral surface of the lower portion 52B at two intersection portions of the outer peripheral surface. When the second photoreceptor drums 32 correspond to the "image forming bodies", the second distance 30B is a distance between the two intersection portions when viewed in the Z direction. When the image forming apparatus 10 is of an inkjet type, the second distance 30B is a distance between center portions of inkjet heads (image forming bodies) corresponding to the second photoreceptor units 30.

As illustrated in FIG. 1, a developing roller 26A, a recovery auger 26B, a supply auger 26C, and a stirring auger 26D are provided inside the first developing portion 26. Similarly, a developing roller 36A, a recovery auger 36B, a supply auger 36C, and a stirring auger 36D are provided inside the second developing portion 36. The supply auger 26C and the stirring auger 26D are arranged in the X direction. In contrast, the supply auger 36C and the stirring auger 36D are arranged in the Y direction. Hence, the horizontal dimension of the second developing portion 36 is shorter than the horizontal dimension of the first developing portion 26. Thus, the horizontal dimension 30L is shorter than the horizontal dimension 20L.

As illustrated in FIG. 1, the two first photoreceptor units 20 are arranged in the X direction when viewed in the Z direction. That is, the two first photoreceptor units 20 are not arranged in the Y direction. In contrast, when viewed in the Z direction, portions of the two second photoreceptor units 30 are arranged in the Y direction. A horizontal dimension 30V illustrated in FIG. 1 is an X-direction dimension of the portions of the two second photoreceptor units 30. A horizontal dimension 30E illustrated in FIG. 1 is a horizontal dimension of a portion including the two second photoreceptor units 30. A horizontal dimension 30G illustrated in FIG. 1 is a horizontal dimension of a portion including the lower portion 52B and the two second photoreceptor units 30.

The first charging portion 24 of each first photoreceptor unit 20 charges an outer peripheral surface of the first photoreceptor drum 22. Then, the first exposure portion 25 exposes the outer peripheral surface of the first photoreceptor drum 22 charged by the first charging portion 24 to light to form an electrostatic latent image on the outer peripheral surface of the first photoreceptor drum 22. The first developing portion 26 develops the electrostatic latent image formed on the outer peripheral surface of the first photoreceptor drum 22 by the first exposure portion 25 to form a toner image. After the toner image is transferred to the transfer belt 52, the first removing portion 27 removes the toner remaining on the outer peripheral surface of the first photoreceptor drum 22.

The second charging portion 34 of each second photoreceptor unit 30 charges an outer peripheral surface of the second photoreceptor drum 32. Then, the second exposure portion 35 exposes the outer peripheral surface of the second photoreceptor drum 32 charged by the second charging portion 34 to light to form an electrostatic latent image on the outer peripheral surface of the second photoreceptor drum 32. The second developing portion 36 develops the electrostatic latent image formed on the outer peripheral surface of the second photoreceptor drum 32 by the second exposure portion 35 to form a toner image. After the toner image is transferred to the transfer belt 52, the second removing portion 37 removes the toner remaining on the outer peripheral surface of the second photoreceptor drum 32.

Transfer Device

As illustrated in FIG. 1, the transfer device 50 includes the four first transfer rollers 41 serving as first transfer bodies, the transfer belt 52 serving as an intermediate transfer body, and a transfer cylinder 85 serving as a second transfer body. That is, the transfer device 50 first transfers the toner images formed on the outer peripheral surfaces of the respective first photoreceptor drums 22 to the transfer belt 52 in a superimposed manner, and second transfers the superimposed toner images to recording paper P.

First Transfer Roller

As illustrated in FIG. 1, each first transfer roller 41 facing the upper portion 52A transfers the toner image formed on the outer peripheral surface of the corresponding first photoreceptor drum 22 to the outer peripheral surface of the transfer belt 52 at a first transfer position T1 between the first photoreceptor drum 22 and the first transfer roller 41. Each first transfer roller 41 facing the lower portion 52B transfers the toner image formed on the outer peripheral surface of the corresponding second photoreceptor drum 32 to the outer peripheral surface of the transfer belt 52 at a first transfer position T1 between the second photoreceptor drum 32 and the first transfer roller 41. In the present exemplary embodiment, a first transfer voltage is applied between the first transfer roller 41 and the first photoreceptor drum 22, and hence the toner image formed on the outer peripheral surface of the first photoreceptor drum 22 is transferred to the outer peripheral surface of the transfer belt 52 at the first transfer position T1. Similarly, a first transfer voltage is applied between the first transfer roller 41 and the second photoreceptor drum 32, and hence the toner image formed on the outer peripheral surface of the second photoreceptor drum 32 is transferred to the outer peripheral surface of the transfer belt 52 at the first transfer position T1.

Each first transfer roller 41 is movable in a thickness direction TD (see an arrow in FIG. 1) of the transfer belt 52. The thickness direction TD of the transfer belt 52 in this specification refers to a thickness direction of the transfer belt 52 when each of retract rollers 39, 40, 47, and 48 described later is located at a pressing position. Further, a rotation shaft of the first transfer roller 41 is urged by an urging member (not illustrated) in a direction toward an inner peripheral surface of the transfer belt 52.

Transfer Belt

The annular transfer belt 52 illustrated in FIG. 1 is wound around the four retract rollers 39, 40, 47, and 48, the driving roller 44, a steering roller 45, a backup roller 46, and a pressing roller 49, and hence the posture is determined.

Each of the retract rollers 39, 40, 47, and 48, which are moving mechanisms of the present exemplary embodiment, is rotatably in contact with the inner peripheral surface of the transfer belt 52 and is movable in a predetermined advance-retract direction RD. Each of the retract rollers 39, 40, 47, and 48 is movable in the advance-retract direction RD between a pressing position and a retracted position that is a position on the inner peripheral side of the transfer belt 52 with respect to the pressing position. The retract roller 39 is located on the downstream side of the first photoreceptor unit 20Y and located on the upstream side of the steering roller 45. The retract roller 40 is located on the upstream side of the second photoreceptor unit 30C and located on the downstream side of the steering roller 45. The retract roller 47 is located on the downstream side of the second photoreceptor unit 30K and located on the upstream side of the backup roller 46. The retract roller 48 is located on the upstream side of the first photoreceptor unit 20Y and located on the downstream side of the driving roller 44.

Figure 2:
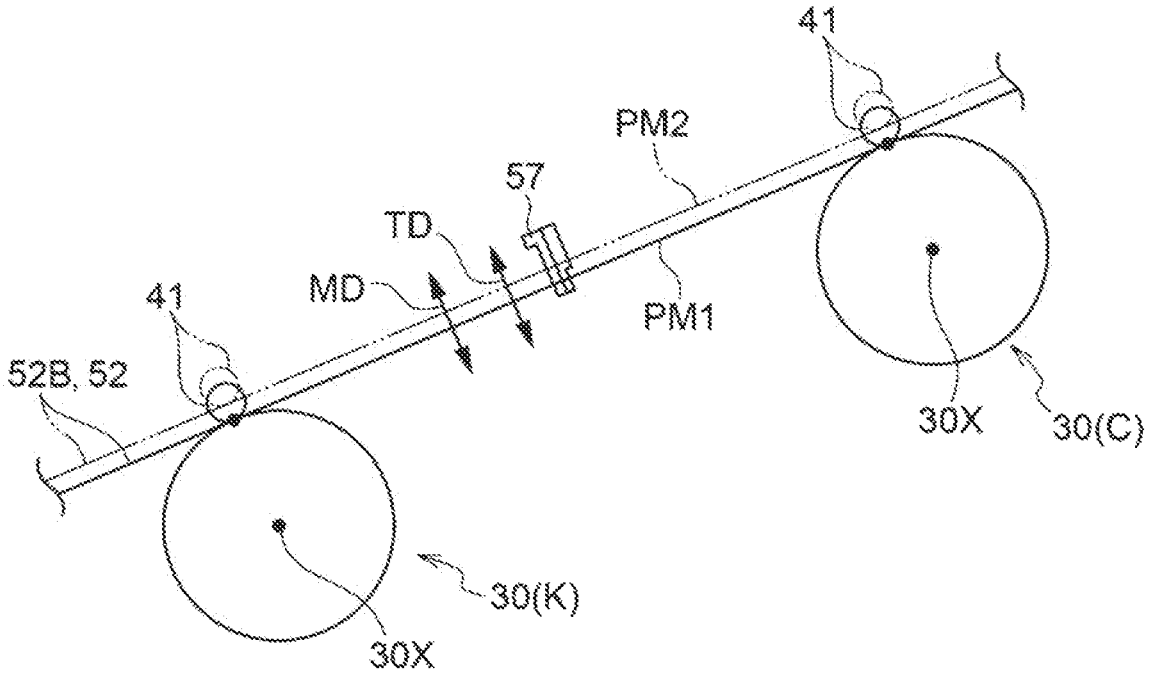
FIG. 2 is a schematic side view illustrating a transfer belt, a first photoreceptor drum, a second photoreceptor drum, a first transfer roller, and a rotational member according to the exemplary embodiment.

The upper portion 52A and the lower portion 52B of the transfer belt 52 are movable in a movement direction MD (see FIG. 1) extending in the thickness direction TD. As illustrated in FIG. 2, when the transfer belt 52 moves in the movement direction MD, the first transfer roller 41 moves in the thickness direction TD following the transfer belt 52.

Figure 3:
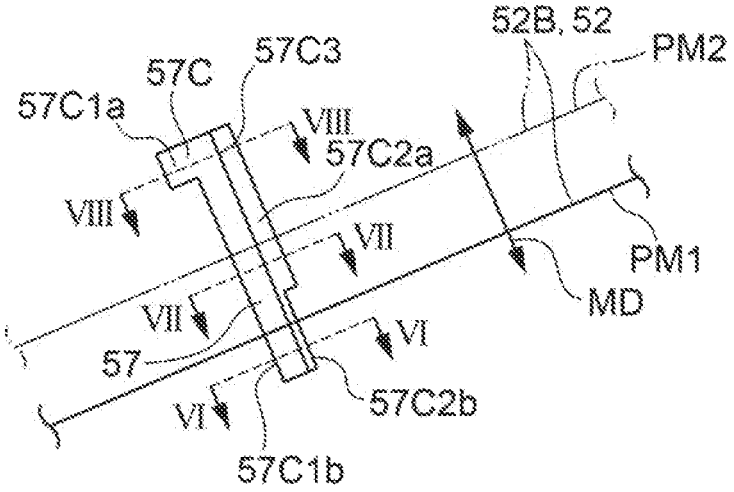
FIG. 3 is a schematic side view illustrating the transfer belt and the rotational member according to the exemplary embodiment.

For example, when the retract rollers 40 and 47 are located at the pressing positions, the lower portion 52B is located at a first transport position PM1 indicated by a solid line in FIGS. 2 and 3. At this time, the second photoreceptor unit 30C and the second photoreceptor unit 30K may transfer the toner images to the transfer belt 52. When the retract rollers 40 and 47 are located at the retracted positions, the lower portion 52B is located at a second transport position PM2 indicated by an imaginary line in FIGS. 2 and 3. At this time, the second photoreceptor unit 30C and the second photoreceptor unit 30K are not able to transfer the toner images to the transfer belt 52. Although illustration is omitted, when the retract roller 39 and the retract roller 48 are located at the pressing positions, the upper portion 52A is located at a first transport position PM1 corresponding to the first transport position PM1 in FIGS. 2 and 3. At this time, the first photoreceptor unit 20Y and the first photoreceptor unit 20M may transfer the toner images to the transfer belt 52. When the retract roller 39 and the retract roller 48 are located at the retracted positions, the upper portion 52A is located at a second transport position PM2 corresponding to the second transport position PM2 in FIGS. 2 and 3. At this time, the first photoreceptor unit 20Y and the first photoreceptor unit 20M are not able to transfer the toner images to the transfer belt 52. By individually controlling the positions of the respective retract rollers 39, 40, 47, and 48, only any one to three of the first and second photoreceptor units 20 and 30 may be brought into a state in which transfer to the transfer belt 52 is possible.

The movement direction MD that is a direction extending in the thickness direction TD of the transfer belt 52 includes a direction completely parallel to the thickness direction TD and a direction slightly inclined with respect to the thickness direction TD. In a case where the movement direction MD is inclined with respect to the thickness direction TD, an inclination angle defined by the movement direction MD and the thickness direction TD when viewed in the Z direction is any angle of 10° or less.

The driving roller 44 having a circular cross section is configured to be rotationally driven around an axis 44X extending in the Z direction by a driver (not illustrated), and causes the transfer belt 52 to circle at a predetermined speed in a circling direction indicated by arrow A.

The diameter of the steering roller 45 having a circular cross section is the same as the diameter of the driving roller 44 within a range of tolerance. In other words, an outer peripheral length 45C of the steering roller 45 and an outer peripheral length 44C of the driving roller 44 are the same within a range of tolerance. The steering roller 45 is rotatable around a rotation axis 45X extending in one direction. The steering roller 45 is an example of a change roller. Further, the steering roller 45 is rotatable around a rotation center shaft that is provided at a center portion of the steering roller 45 in a direction along the rotation axis 45X and that intersects with the rotation axis 45X. The position of the steering roller 45 in the rotation direction around the rotation center shaft when the rotation axis 45X is parallel to the Z direction is a neutral position of the steering roller 45. Further, the transfer device 50 includes a driving mechanism (not illustrated) that rotates the steering roller 45 by applying a driving force to the steering roller 45. When the driving mechanism applies, to the steering roller 45, a driving force corresponding to a movement amount (meandering amount) of the transfer belt 52 in the width direction detected by movement amount detection devices 17A and 17B described later, the meandering of the transfer belt 52 is suppressed by the steering roller 45 that is rotated.

The first distance 20B of the two first photoreceptor drums 22 and the second distance 30B of the two second photoreceptor drums 32 are set to be integral multiples of the outer peripheral length 44C of the driving roller 44 and the outer peripheral length 45C of the steering roller 45. The second distance 30B is shorter than the first distance 20B. For example, the first distance 20B of the present exemplary embodiment is set to be four times the outer peripheral length 44C and the outer peripheral length 45C, and the second distance 30B is set to be three times the outer peripheral length 44C and the outer peripheral length 45C.

A distance along the transfer belt 52 between the first transfer position T1 of the first photoreceptor drum 22 on the downstream side and the first transfer position T1 of the second photoreceptor drum 32 on the upstream side is different from the first distance 20B and the second distance 30B. The distance along the transfer belt 52 between the first transfer position T1 of the first photoreceptor drum 22 on the downstream side and the first transfer position T1 of the second photoreceptor drum 32 on the upstream side is also set to an integral multiple of the outer peripheral length 44C of the driving roller 44 and the outer peripheral length 45C of the steering roller 45.

The backup roller 46 faces the transfer cylinder 85 with the transfer belt 52 interposed therebetween. A region where the transfer cylinder 85 and the transfer belt 52 are in contact with each other is the nip region Np (see FIG. 1). The nip region Np is the second transfer position T2 where the toner images are transferred from the transfer belt 52 to the recording paper P.

Further, the pressing roller 49 located on the upstream side of the retract roller 48 and on the downstream side of the driving roller 44 is rotatably in contact with the outer peripheral surface of the transfer belt 52 and presses the transfer belt 52 toward the inner peripheral side.

Movement Amount Detection Device

Figure 4:
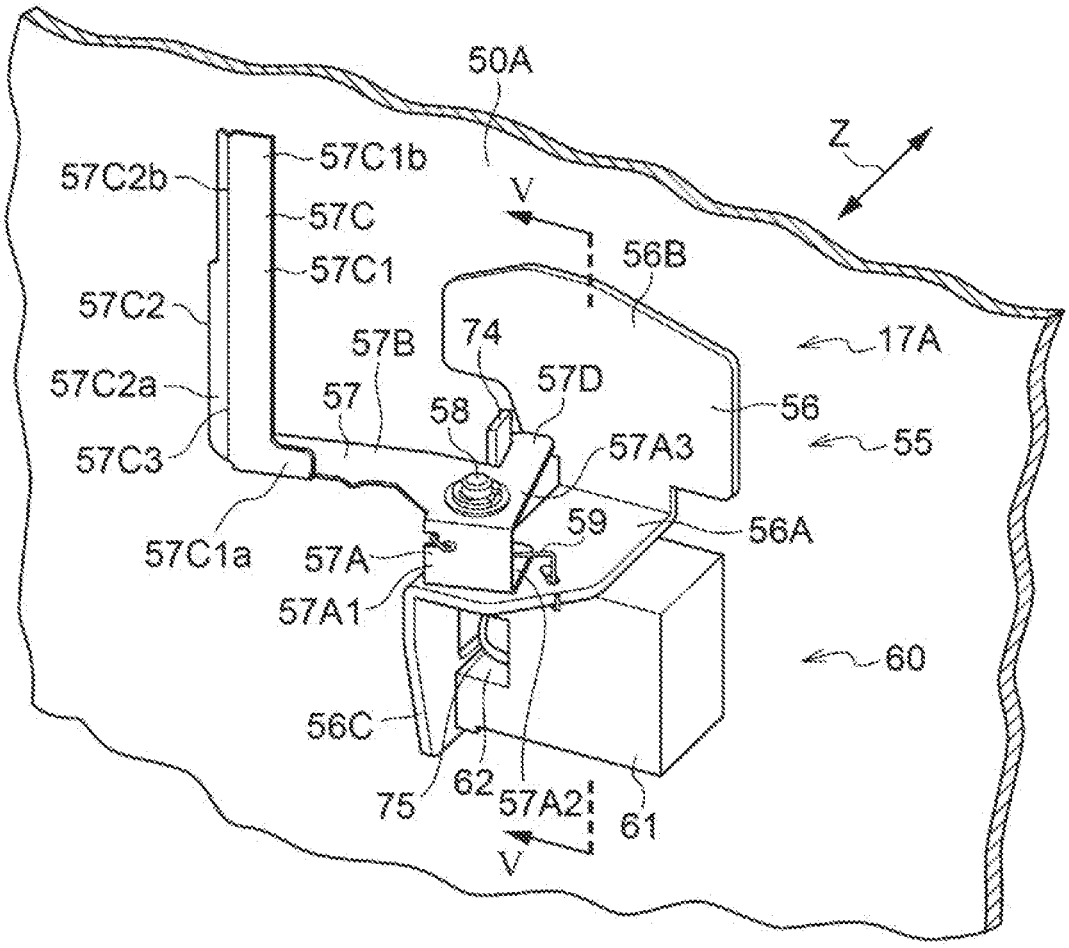
FIG. 4 is a perspective view illustrating a movement amount detection device of the exemplary embodiment.
Figure 5:
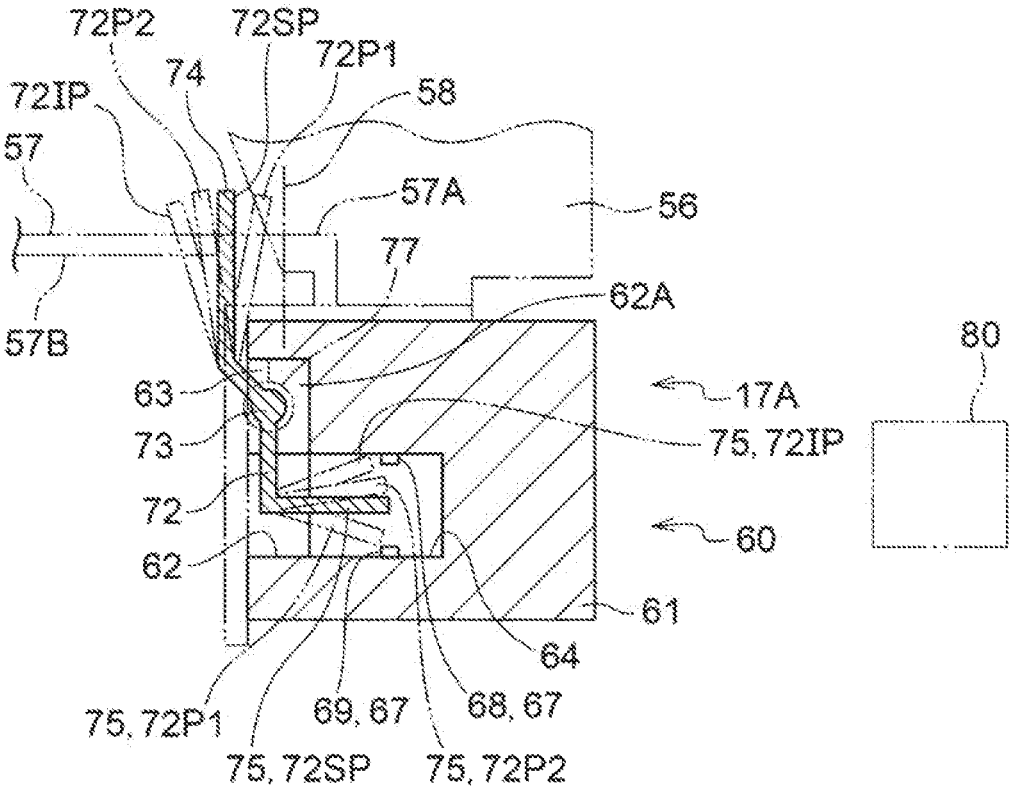
FIG. 5 is a cross-sectional view of the movement amount detection device taken along line V-V in FIG. 4.

A base plate 50A (not illustrated in FIG. 1, see FIG. 4) on which the first transfer rollers 41, the retract rollers 39, 40, 47, and 48, and the driving roller 44 are supported is provided with two movement amount detection devices 17A and 17B. One movement amount detection device 17A is disposed in the vicinity of one side surface 52G in the width direction of the upper portion 52A, and is located on the downstream side of the first photoreceptor unit 20Y and on the upstream side of the first photoreceptor unit 20M. The other movement amount detection device 17B is disposed in the vicinity of one side surface 52G in the width direction of the lower portion 52B, and is located on the downstream side of the second photoreceptor unit 30C and on the upstream side of the second photoreceptor unit 30K. As illustrated in FIGS. 4 and 5, the movement amount detection devices 17A and 17B each include a rotation unit 55 and a detection unit 60.

The rotation unit 55 includes a support member 56, a rotational member 57, a rotation shaft 58, and a coil spring 59. The support member 56, which is a metallic press-formed product, includes a first connecting portion 56A, a fixed portion 56B, and a second connecting portion 56C. The first connecting portion 56A and the fixed portion 56B intersect with each other, and the first connecting portion 56A and the second connecting portion 56C intersect with each other.

The rotational member 57, which is a metallic press-formed product, includes a base portion 57A, a coupling portion 57B, a rotating portion 57C, and a pressing portion 57D. The base portion 57A includes a vertical wall portion 57A1, a lower portion 57A2, and an upper portion 57A3. The lower portion 57A2 and the upper portion 57A3 are respectively connected to both end portions of the vertical wall portion 57A1. The lower portion 57A2 and the upper portion 57A3 intersect with the vertical wall portion 57A1. That is, the cross-sectional shape of the base portion 57A is substantially U-shaped.

One end portion of a metallic rotation shaft 58 extending in a direction intersecting with the Z direction is fixed to the first connecting portion 56A. The rotation shaft 58 penetrates through the lower portion 57A2 and the upper portion 57A3. The base portion 57A (rotational member 57) is rotatable relative to the support member 56 around the rotation shaft 58.

One end portion of the coupling portion 57B having a flat plate shape and extending in one direction is connected to the upper portion 57A3. The upper portion 57A3 and the coupling portion 57B are located on the same plane. One end portion of the rotating portion 57C extending in a direction intersecting with the coupling portion 57B is connected to the other end portion of the coupling portion 57B. When viewed along the rotation shaft 58, the rotating portion 57C is located on the outer peripheral side of the rotation shaft 58.

The rotating portion 57C includes a first plate-shaped portion 57C1, a second plate-shaped portion 57C2, and a contact portion 57C3. The rotating portion 57C (the first plate-shaped portion 57C1, the second plate-shaped portion 57C2, and the contact portion 57C3) extends in a direction along the rotation shaft 58. In this case, the expression "extends in a direction along the rotation shaft 58" includes that the rotating portion 57C extends in a direction completely parallel to the rotation shaft 58 and that the rotating portion 57C extends in a direction slightly inclined with respect to the rotation shaft 58. In a case where the rotating portion 57C is inclined with respect to the rotation shaft 58, an inclination angle defined by the rotating portion 57C and the rotation shaft 58 when viewed in the Z direction is any angle of 10° or less.

Figure 6:
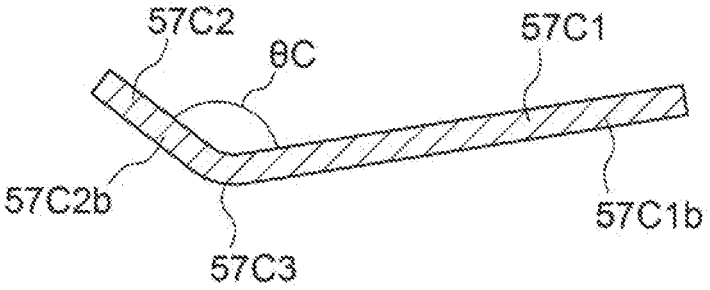
FIG. 6 is a cross-sectional view of the rotational member taken along line VI-VI in FIG. 3.
Figure 7:
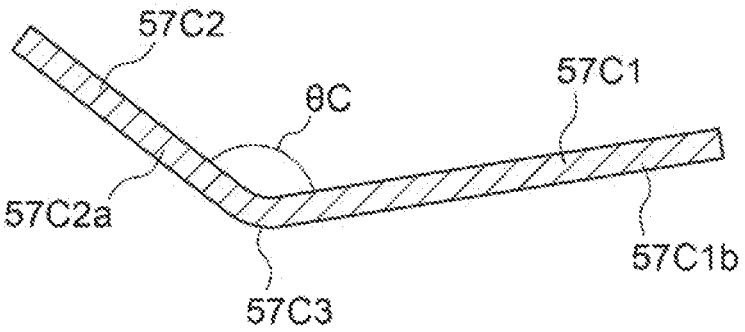
FIG. 7 is a cross-sectional view of the rotational member taken along line VII-VII in FIG. 3.
Figure 8:
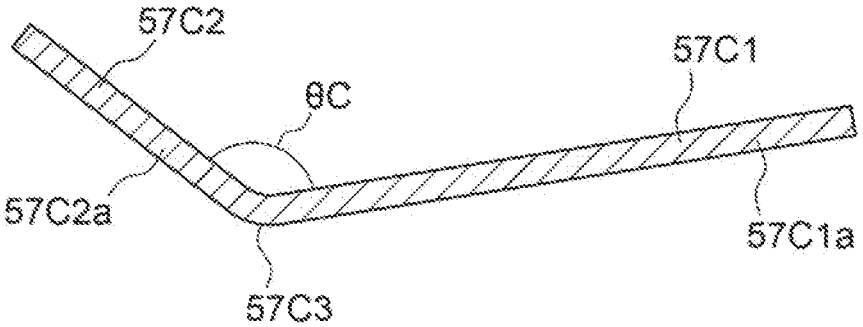
FIG. 8 is a cross-sectional view of the rotational member taken along line VIII-VIII in FIG. 3.

As illustrated in FIGS. 6 to 8, the first plate-shaped portion 57C1 and the second plate-shaped portion 57C2 intersect with each other when viewed along the rotation shaft 58. An intersection angle θC between the first plate-shaped portion 57C1 and the second plate-shaped portion 57C2 is an obtuse angle. The first plate-shaped portion 57C1 includes a wide portion 57C1*a* and a narrow portion 57C1*b*. The wide portion 57C1*a* is one end portion of the first plate-shaped portion 57C1 in the longitudinal direction. The narrow portion 57C1*b*, which is a portion of the first plate-shaped portion 57C1 excluding one end portion, is narrower than the wide portion 57C1*a*. The second plate-shaped portion 57C2 includes a wide portion 57C2*a* and a narrow portion 57C2*b*. The narrow portion 57C2*b* is narrower than the wide portion 57C2*a*. The longitudinal dimension of the wide portion 57C2*a* is larger than the longitudinal dimension of the wide portion 57C1*a*. The contact portion 57C3 is formed at a portion of one surface of the rotating portion 57C. As described later, the one surface of the rotating portion 57C faces the one side surface 52G of the transfer belt 52. The straight-line-shaped contact portion 57C3 extending in a direction along the rotation shaft 58 is a connecting portion between the first plate-shaped portion 57C1 and the second plate-shaped portion 57C2. As illustrated in FIGS. 6 to 8, the contact portion 57C3 is a round surface.

One end portion of the pressing portion 57D having a flat plate shape and extending in one direction is connected to the upper portion 57A3. That is, the upper portion 57A3, the coupling portion 57B, and the pressing portion 57D are located on the same plane.

As illustrated in FIG. 4, both end portions of the coil spring (second urging member) 59 are respectively fixed to the first connecting portion 56A of the support member 56 and the vertical wall portion 57A1 of the rotational member 57. The coil spring 59 is normally elastically deformed. Thus, the rotational member 57 is urged to rotate in the counterclockwise direction in FIG. 9 by the urging force generated by the coil spring 59.

The detection unit 60 includes a case 61, an optical sensor 67, an interlocking member 72, and a coil spring (first urging member) 77.

The case 61 has a shape obtained by processing a portion of a rectangular parallelepiped. That is, a recessed portion 62 is formed in one surface (left side surface in FIG. 5) of the case 61. Both end portions in the Z direction of one end portion 62A of the recessed portion 62 in a direction along the rotation shaft 58 are closed by a pair of support walls 63. Although not illustrated, bearing portions are formed at the pair of support walls 63. In contrast, both end portions in the Z direction of a portion of the recessed portion 62 excluding the one end portion 62A are opened. Further, a space 64 is formed inside the case 61. As illustrated in FIG. 5, the space 64 communicates with the portion of the recessed portion 62 excluding the one end portion 62A. The optical sensor 67 is fixed to an inner surface of the space 64. The optical sensor 67 includes a light emitting element 68 and a light receiving element 69 that face each other. Inspection light emitted from the light emitting element 68 is received by the light receiving element 69. The light emitting element 68, the light receiving element 69, and the above-described driving mechanism are connected to a control device (detector) 80 illustrated in FIG. 5.

The control device 80 includes a central processing unit (CPU, or processor), a read only memory (ROM), a random access memory (RAM), a storage, a communication interface (I/F), and an input/output I/F. The CPU, the ROM, the RAM, the storage, the communication I/F, and the input/output I/F are communicably connected to one another via a bus. The CPU is a central processing unit and executes various programs and controls each component. That is, the CPU reads a program from the ROM or the storage, and executes the program using the RAM as a work area. The CPU controls the driving mechanism and performs various types of calculation processing in accordance with the program. This calculation processing includes calculation processing of the movement amount in the width direction of the transfer belt 52 based on the light amount of the inspection light received by the light receiving element 69.

An interlocking member 72 is an integrally molded product including a supported shaft 73, a pressed portion 74, and a detected portion 75. One end portion of the pressed portion 74 and one end portion of the detected portion 75 are connected to the supported shaft 73 extending in the Z direction. As illustrated in FIG. 5, the pressed portion 74 has a substantially V-shaped cross section, and the detected portion 75 has a substantially L-shaped cross section.

As illustrated in FIG. 5, both end portions of the interlocking member 72 are rotatably supported by the bearing portions of the pair of support walls 63. A distal end portion of the detected portion 75 is located inside the space 64. Most of the pressed portion 74 is located outside the case 61.

Further, as illustrated in FIG. 5, both end portions of the coil spring 77 are respectively fixed to an inner surface of the one end portion 62A and the supported shaft 73. The coil spring 77 is normally elastically deformed. Thus, the interlocking member 72 is urged to rotate in the clockwise direction in FIG. 5 by the urging force generated by the coil spring 77. The urging force of the coil spring 77 is smaller than the urging force of the coil spring 59.

As illustrated in FIGS. 4 and 5, the rotation unit 55 and the detection unit 60 are connected to each other. To be specific, the first connecting portion 56A of the support member 56 is fixed to one surface (an upper surface in FIG. 5) of the case 61, and the second connecting portion 56C is fixed to another surface (a left side surface in FIG. 5) of the case 61. When the rotation unit 55 and the detection unit 60 are connected to each other, the pressing portion 57D of the rotational member 57 and the pressed portion 74 of the interlocking member 72 come into contact with each other. As described above, the urging force of the coil spring 77 is smaller than the urging force of the coil spring 59. Thus, the pressing portion 57D (rotational member 57) is rotated in the counterclockwise direction in FIG. 9 by the coil spring 59, and the interlocking member 72 (pressed portion 74) in contact with the pressing portion 57D is rotated in the counterclockwise direction in FIG. 5 against the urging force of the coil spring 77. When external forces other than those of the coil spring 59 and the coil spring 77 are not applied to the rotational member 57 and the interlocking member 72, the rotational member 57 is located at an initial position 57IP indicated by an imaginary line in FIG. 9, and the interlocking member 72 is located at an initial position 72IP indicated by an imaginary line in FIG. 5. The rotation unit 55 is provided with a stopper (not illustrated) for restricting counterclockwise rotation of the rotational member 57 around the rotation shaft 58 at the initial position 57IP. Further, the fixed portion 56B of the support member 56 of each of the movement amount detection device 17A and the movement amount detection device 17B each constituted by connecting the rotation unit 55 and the detection unit 60 is fixed to the base plate 50A by bolts or the like.

When the fixed portion 56B is fixed to the base plate 50A, an extension direction of the rotation shaft 58 becomes a direction extending in the movement direction MD. In other words, the extension direction of the rotating portion 57C and the rotation shaft 58 intersects with the transport direction of the transfer belt 52. In this case, the expression "direction extending in the movement direction MD" includes a direction completely parallel to the movement direction MD and a direction slightly inclined with respect to the movement direction MD. In a case where the rotation shaft 58 is inclined with respect to the movement direction MD, an inclination angle defined by the movement direction MD and the axis of the rotation shaft 58 when viewed in the Z direction is any angle of 10° or less.

When the detected portion 75 is not located between the light emitting element 68 and the light receiving element 69, the light receiving element 69 receives all inspection light emitted by the light emitting element 68. When the detected portion 75 is located between the light emitting element 68 and the light receiving element 69, the light receiving element 69 is not able to receive all or part of the inspection light emitted by the light emitting element 68. That is, the light amount of the inspection light received by the light receiving element 69 changes in accordance with the rotation angle of the detected portion 75 (interlocking member 72) around the supported shaft 73. In other words, the light amount of the inspection light received by the light receiving element 69 changes in accordance with the rotation angle of the rotational member 57 (rotating portion 57C) rotating in association with the detected portion 75 around the rotation shaft 58.

Figure 9:
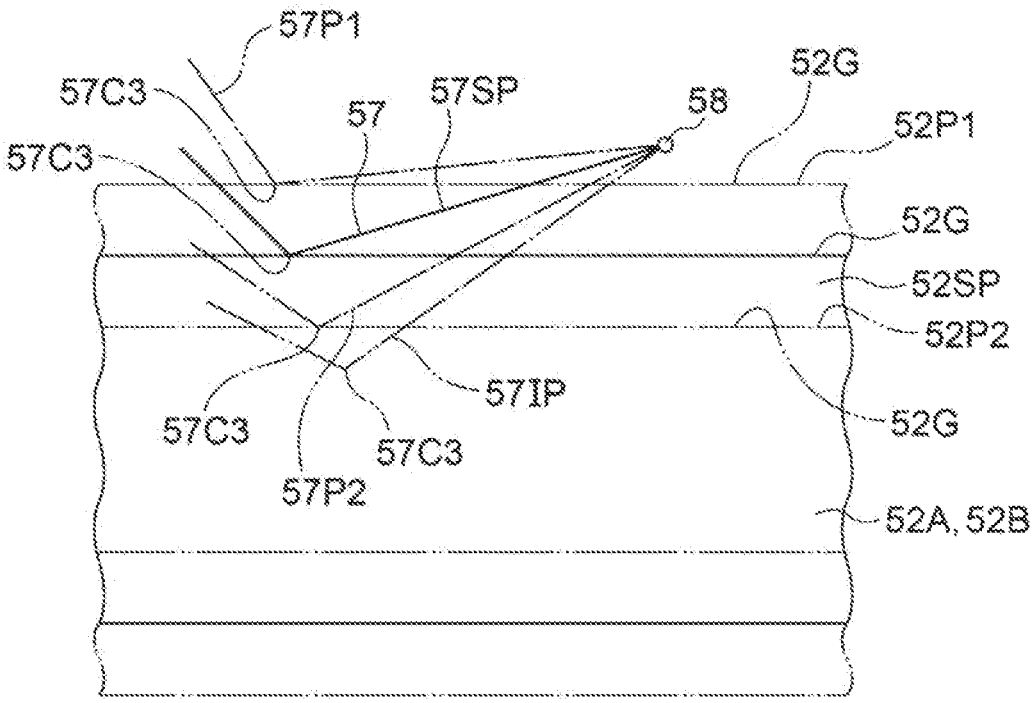
FIG. 9 is a schematic plan view of the rotational member and the transfer belt according to the exemplary embodiment.

As illustrated in FIGS. 1 and 9, the contact portion 57C3 of the rotating portion 57C of the movement amount detection device 17A disposed in the vicinity of the upper portion 52A is in contact with the side surface 52G of the upper portion 52A. Similarly, as illustrated in FIGS. 2, 3, and 9, the contact portion 57C3 of the rotating portion 57C of the movement amount detection device 17B disposed in the vicinity of the lower portion 52B is in contact with the side surface 52G of the lower portion 52B. Further, even when the retract rollers 39, 40, 47, and 48 are located at any positions in the movement direction MD, the contact state between the contact portion 57C3 of the movement amount detection device 17A and the side surface 52G of the upper portion 52A is maintained, and the contact state between the contact portion 57C3 of the movement amount detection device 17B and the side surface 52G of the lower portion 52B is maintained.

In this case, a position in the width direction of the transfer belt 52 indicated by a solid line in FIG. 9 is defined as a reference position 52SP. When the transfer belt 52 is located at the reference position 52SP, the rotational member 57 (rotating portion 57C) is located at a reference rotational position 57SP indicated by a solid line in FIG. 9 in a plan view. The reference rotational position 57SP is a position rotated by only a predetermined angle in the clockwise direction in plan view from the initial position 57IP indicated by an imaginary line in FIG. 9. At this time, the interlocking member 72 is located at a reference rotational position 72SP indicated by a solid line in FIG. 5.

The transfer belt 52 is movable in the width direction. That is, the transfer belt 52 is movable in the up-down direction in FIG. 9 from the reference position 52SP. When the transfer belt 52 moves to a first position 52P1 indicated by an imaginary line in FIG. 9, the rotating portions 57C (contact portions 57C3) of the movement amount detection devices 17A and 17B that is in contact with the side surface 52G of the transfer belt 52 each move from the reference rotational position 57SP to a first rotational position 57P1 indicated by the imaginary line following the transfer belt 52. As a result, the interlocking member 72 moves from the reference rotational position 72SP to a first rotational position 72P1 indicated by an imaginary line in FIG. 5. In contrast, when the transfer belt 52 moves to a second position 52P2 indicated by an imaginary line in FIG. 9, the rotating portion 57C (contact portion 57C3) of the movement amount detection device 17A that is in contact with the side surface 52G of the transfer belt 52 moves from the reference rotational position 57SP to a second rotational position 57P2 indicated by the imaginary line following the transfer belt 52. As a result, the interlocking member 72 moves from the reference rotational position 72SP to a second rotational position 72P2 indicated by an imaginary line in FIG. 5. The first position 52P1 is a position of the transfer belt 52 when the transfer belt 52 according to the present exemplary embodiment is maximally moved upward in FIG. 9. The second position 52P2 is a position of the transfer belt 52 when the transfer belt 52 according to the present exemplary embodiment is maximally moved downward in FIG. 9. In this manner, the urging forces of the coil spring 59 and the coil spring 77 are used to maintain the contact state between the contact portion 57C3 of the rotational member 57 and the side surface 52G of the transfer belt 52 and the contact state between the pressing portion 57D and the interlocking member 72 (pressed portion 74). The rotational member 57 and the interlocking member 72 are rotated in association with the movement of the belt 52 in the width direction.

Transport Section

As illustrated in FIG. 1, the transport section 16 includes a transport device (not illustrated) that transports recording paper P sent out from the storage section 14 in a direction of arrow B. The recording paper P sent out from the storage section 14 is transported to the transfer cylinder 85 by the transport device. The recording paper P on which a toner image has been second-transferred by passing through the transfer cylinder 85 (second transfer position T2) is transported to the fixing device 18 by the transport device.

Fixing Device

As illustrated in FIG. 1, the fixing device 18 includes a heating roller 42 as an example of a heating member and a pressure roller 43 as an example of a pressure member. The fixing device 18 fixes the toner image transferred to the recording paper P by the transfer cylinder 85 to the recording paper P by sandwiching the recording paper P between the heating roller 42 and the pressure roller 43 and heating and pressing the recording paper P.

Next, operations and effects of the image forming apparatus 10 configured as described above will be described in detail.

In the image forming apparatus 10 according to the present exemplary embodiment, the transfer belt 52 that is circled in the arrow A direction by the driving force generated by the driving roller 44 may meander in the width direction. That is, the transfer belt 52 may move from the reference position 52SP toward the first position 52P1 and toward the second position 52P2, and the rotational member 57 (rotating portion 57C) may rotate from the reference rotational position 57SP to the first rotational position 57P1 and the second rotational position 57P2. In other words, the interlocking member 72 may rotate from the reference rotational position 72SP to the first rotational position 72P1 and the second rotational position 72P2. Consequently, as illustrated in FIG. 5, the position of the detected portion 75 in the rotation direction changes. Thus, the light amount (physical amount) of the inspection light received by the light receiving element 69 changes. That is, the light amount of the inspection light received by the light receiving element 69 changes due to the rotation of the rotating portion 57C around the rotation shaft 58. That is, the light amount of the inspection light received by the light receiving element 69 changes due to the movement amount of the transfer belt 52 in the width direction from the reference position 52SP.

Information relating to the light amount of the inspection light received by the light receiving element 69 is transmitted from the light receiving element 69 to the control device 80. The control device 80 that has received this information calculates the movement amount of the transfer belt 52 in the width direction from the reference position 52SP based on the information and controls the above-described driving mechanism.

In the image forming apparatus 10 according to the present exemplary embodiment, the upper portion 52A and the lower portion 52B of the transfer belt 52 are movable between the first transport position PM1 and the second transport position PM2 in the movement direction MD. As described above, even when the retract rollers 39, 40, 47, and 48 are located at any positions in the movement direction MD, the contact state between the contact portion 57C3 of the movement amount detection device 17A and the side surface 52G of the upper portion 52A is maintained, and the contact state between the contact portion 57C3 of the movement amount detection device 17B and the side surface 52G of the lower portion 52B is maintained. Further, the straight-line-shaped contact portion 57C3 of the rotating portion 57C extends in the direction along the rotation shaft 58. Thus, even when the position of the transfer belt 52 in the thickness direction TD changes, the magnitude of the rotation angle of the rotational member 57 (rotating portion 57C) per unit movement amount of the transfer belt 52 in the width direction is constant. For this reason, the movement amount detection devices 17A and 17B (optical sensor 67) of the present exemplary embodiment may accurately acquire a physical amount (light amount) as compared with a case of acquiring a physical amount (light amount) that changes due to rotation of a rotating portion that is rotatable around a rotation shaft extending in the transport direction of the transfer belt 52. Thus, the image forming apparatus 10 according to the present exemplary embodiment may accurately detect the movement amount in the width direction of the transfer belt 52 whose position in the thickness direction TD changes, as compared with the case of acquiring the physical amount (light amount) that changes due to the rotation of the rotating portion that is rotatable around the rotation shaft extending in the transport direction of the transfer belt 52.

Figure 10:
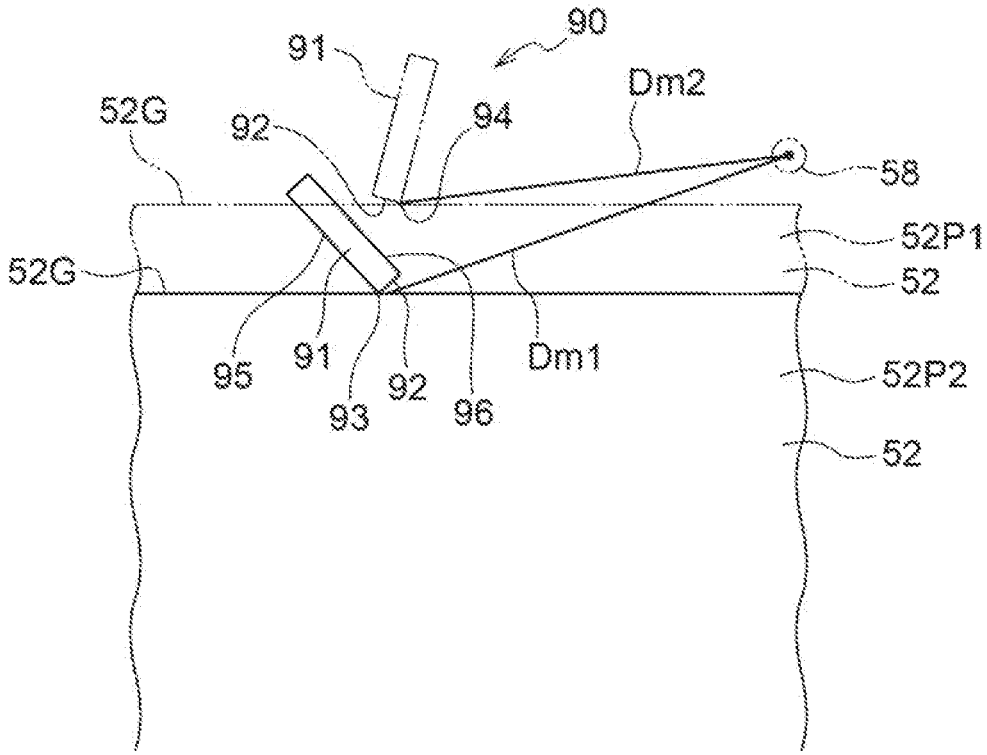
FIG. 10 is a schematic plan view of a rotational member and a transfer belt according to a comparative example.

FIG. 10 illustrates a rotational member 90 according to a comparative example of the present disclosure. A rotating portion 91 of the rotational member 90 is a plate-shaped member having a rectangular cross-sectional shape. That is, an outer peripheral surface of the rotating portion 91 is constituted by four flat surfaces. A first corner portion 93 is formed between a first surface 92, which is one of the four surfaces, and a second surface 95 adjacent to the first surface 92. Similarly, a second corner portion 94 is formed between the first surface 92 and a third surface 96 adjacent to the first surface 92. The rotational member 90 extends in a direction parallel to a rotation shaft 58. As indicated by a solid line in FIG. 10, when the transfer belt 52 is located at a second position 52P2, the first corner portion 93 of the rotating portion 91 is in contact with a side surface 52G of a transfer belt 52. Further, when the transfer belt 52 is located at a first position 52P1, the second corner portion 94 of the rotating portion 91 is in contact with the side surface 52G.

A line segment Dm1 illustrated in FIG. 10 connects the rotation shaft 58 and the first corner portion 93, and a line segment Dm2 connects the rotation shaft 58 and the second corner portion 94. The line segment Dm1 is longer than the line segment Dm2. That is, the length of the line segment Dm1 differs from the length of the line segment Dm2. Hence, the rotation angle of the rotating portion 91 around the rotation shaft 58 when the transfer belt 52 moves from the second position 52P2 in the width direction by only a unit movement amount differs from the rotation angle of the rotating portion 91 around the rotation shaft 58 when the transfer belt 52 moves from the first position 52P1 in the width direction by only the unit movement amount. Hence, there is a possibility that the optical sensor 67 of this comparative example is not able to accurately acquire the amount of received light (physical amount) that changes due to the rotation of the rotational member 90. Thus, there is a possibility that the accuracy of the calculation amount (the movement amount of the transfer device 50 in the width direction) obtained by the control device 80 based on the amount of received light is lowered.

In contrast, the contact portion 57C3 of the rotating portion 57C of the image forming apparatus 10 according to the present exemplary embodiment has a straight-line shape (round surface shape) extending in the direction along the rotation shaft 58. Hence, even when the rotational position of the rotating portion 57C changes, the length of the line segment connecting the rotation shaft 58 and the contact position between the contact portion 57C3 and the side surface 52G of the transfer belt 52 does not change. Thus, the image forming apparatus 10 according to the present exemplary embodiment may more accurately detect the movement amount of the transfer belt 52 in the width direction than a case where a portion of the flat-surface-shaped first surface 92 is brought into contact with the side surface 52G of the transfer belt 52.

The first corner portion 93 and the second corner portion 94 in FIG. 10 are constituted by corner portions of a plate-shaped member. Hence, when the first corner portion 93 and the second corner portion 94 come into contact with the side surface 52G of the transfer belt 52, the transfer belt 52 is easily damaged. In contrast, the contact portion 57C3 of the rotating portion 57C of the image forming apparatus 10 according to the present exemplary embodiment has a round surface shape. Thus, the rotating portion 57C of the rotational member 57 according to the present exemplary embodiment is less likely to damage the transfer belt 52 than a case where the first corner portion 93 and the second corner portion 94 constituted by the corner portions of the plate-shaped member are brought into contact with the side surface 52G of the transfer belt 52.

Further, in the image forming apparatus 10 according to the present exemplary embodiment, the cross section of the rotating portion 57C intersecting with the direction along the rotation shaft 58 has different areas depending on the position of the rotating portion 57C in the direction. That is, in this case, a proximal end portion of the rotating portion 57C that is an end portion connected to the coupling portion 57B is defined as "one end portion", and an end portion of the rotating portion 57C provided with the narrow portion 57C2*b* is defined as "the other end portion". In this case, as is clear from FIGS. 6 to 8, the area of a cross section of a portion of the rotating portion 57C excluding the other end portion of the rotating portion 57C is larger than the area of a cross section of the other end portion of the rotating portion 57C. In other words, the area of the cross section of the portion illustrated in FIGS. 7 and 8 is larger than the area of the cross section of the portion illustrated in FIG. 6. The mechanical strength of the rotating portion 57C having such a configuration is higher than that in a case where the area of the cross section of the entire rotating portion 57C intersecting with the direction along the rotation shaft 58 is the same as the area of the cross section of the other end portion. Further, as compared with a case where the area of the cross section of the entire rotating portion 57C intersecting with the direction along the rotation shaft 58 is the same as the area of the cross section of the other end portion, the rotational operation of the rotating portion 57C having such a configuration around the rotation shaft 58 is stabilized.

Further, the rotating portion 57C of the image forming apparatus 10 according to the present exemplary embodiment has a plate-shaped structure. For this reason, the rotational operation of the rotating portion 57C of the image forming apparatus 10 is smooth as compared with a case where the rotating portion is a block body.

Further, the image forming apparatus 10 according to the present exemplary embodiment includes the coil spring 77 that applies a force to the interlocking member 72 in a direction in which the interlocking member 72 is brought into contact with the rotational member 57. Thus, the structure of the image forming apparatus 10 according to the present exemplary embodiment is simpler than that in a case where the rotational member 57 and the interlocking member 72 are coupled via a link member.

Further, the image forming apparatus 10 according to the present exemplary embodiment includes the coil spring 59 that applies a force to the rotational member 57 in a direction in which the contact portion 57C3 is brought into contact with the side surface 52G of the transfer belt 52. Thus, the structure of the image forming apparatus 10 according to the present exemplary embodiment is simpler than that in a case where the contact portion 57C3 (rotational member 57) and the transfer belt 52 are connected by a relatively displaceable mechanism.

Further, the rotational member 57 of the image forming apparatus 10 according to the present exemplary embodiment includes the pressing portion 57D that may come into contact with the pressed portion 74 of the detection unit 60. Accordingly, the image forming apparatus 10 according to the present exemplary embodiment may detect the movement amount of the transfer belt 52 in the width direction in which the position in the thickness direction TD changes by using the detection unit 60 including the interlocking member 72 and the optical sensor 67.

The second distance (adjacent distance) 30B, which is the distance between the rotation axes 30X of the two second photoreceptor drums 32 (image forming bodies) located on the downstream side of the steering roller 45 and on the upstream side of the transfer position to recording paper P, is an integral multiple of the outer peripheral length 45C of the steering roller 45. Thus, as compared with a case where the second distance 30B is different from an integral multiple of the outer peripheral length 45C, an increase in displacement amount of registration of toner images formed on the transfer belt (formation target body) 52 by the two second photoreceptor drums 32 located on the downstream side of the steering roller 45 is suppressed.

Further, in the image forming apparatus 10, the first distance 20B between the two first photoreceptor drums 22 and the second distance 30B between the two second photoreceptor drums 32 each are set to be an integral multiple of the outer peripheral length 44C of the driving roller 44. Thus, as compared with a case where the first distance 20B and the second distance 30B are set to lengths different from integral multiples of the outer peripheral length 44C, an increase in displacement amount of registration of toner images formed on the transfer belt (formation target body) 52 by the two second photoreceptor drums 32 located on the downstream side of the steering roller 45 is suppressed.

Further, the second distance 30B between the two second photoreceptor drums 32 located on the downstream side of the first photoreceptor drums 22 is shorter than the first distance 20B. In a comparative example (not illustrated) in which the second distance 30B is set to be longer than or equal to the first distance 20B, the second distance 30B is set to meet the first distance 20B. Thus, the distance along the transfer belt 52 from the driving roller 44 to the second photoreceptor unit 30K is shorter in this exemplary embodiment than that in the comparative example. As the distance increases, the cumulative amounts of the speed fluctuation of the transfer belt 52 and the error of the adjacent distance increase. Thus, in the comparative example, the displacement amount of the registration of the toner images between the second photoreceptor unit 30C and the second photoreceptor unit 30K is likely to be larger than the displacement amount of the registration of the toner images between the first photoreceptor unit 20Y and the first photoreceptor unit 20M. In contrast, in the exemplary embodiment, since the distance (second distance 30B) between the second photoreceptor unit 30C and the second photoreceptor unit 30K is shorter than that in the comparative example, the cumulative amounts of the speed fluctuation and the error of the adjacent distance are smaller than those in the comparative example. Thus, in the present exemplary embodiment, as compared with a case where the second distance 30B is set to be a length longer than or equal to the first distance 20B, an increase in the displacement amount of the registration of the toner images is suppressed as the position of the photoreceptor drum is located on the downstream side of the transfer belt 52.

Although the image forming apparatus 10 and the movement amount detection devices 17A and 17B according to the present exemplary embodiment have been described above based on the drawings, the image forming apparatus 10 and the movement amount detection devices 17A and 17B according to the present exemplary embodiment are not limited to those illustrated in the drawings, and may be appropriately changed in design without departing from the gist of the present disclosure.

For example, the image forming apparatus 10 may be configured such that each of the first photoreceptor units 20 and each of the second photoreceptor units 30 form toner images on recording paper P (formation target body) transported by a transport belt (not illustrated) provided instead of the transfer belt 52.

In the present exemplary embodiment, a toner image is described as an example of an image. In this case, the toner image is formed by a dry electrophotographic system, but the present disclosure is not limited to this. For example, an image of the present disclosure may be a toner image formed by a wet electrophotographic system or an image formed by an inkjet system.

Further, the image forming apparatus 10 may be configured such that an ink image or a toner image is formed on an elongated non-annular continuous paper (formation target body) that is wound around multiple rotating bodies including the driving roller 44 and that is transported by the driving roller 44 and the rotating bodies while having a shape having at least one straight portion when viewed in the Z direction, and such that the steering roller (change roller) 45 is rotatably in contact with the inner peripheral surface of the continuous paper.

Figure 11:
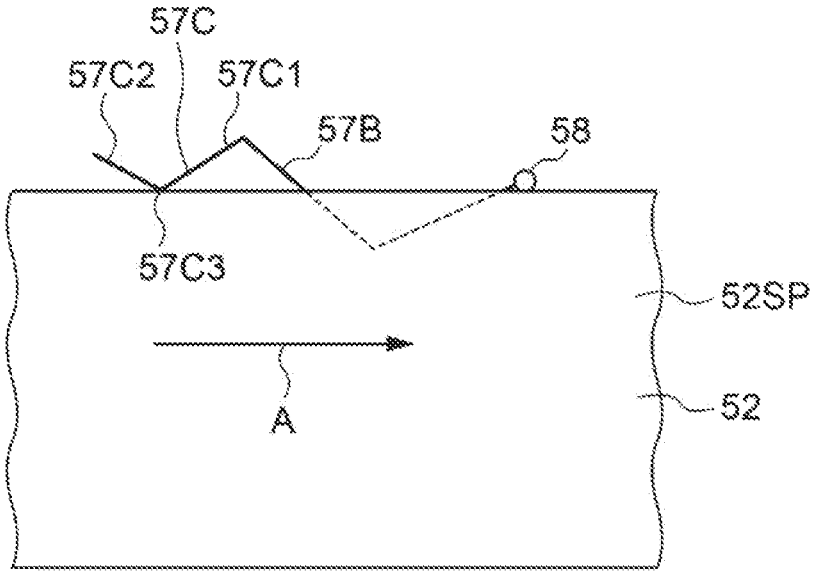
FIG. 11 is a schematic plan view of a rotational member, a rotation shaft, and a transfer belt according to a modification.

When the transfer belt 52 is located at the reference position 52SP, an angle formed by a straight line (not illustrated) connecting the contact portion 57C3 and the rotation shaft 58 in plan view and the transport direction A of the transfer belt 52 may be as small as possible. That is, when this angle is small, the difference between the rotation amount of the rotating portion 57C around the rotation shaft 58 when the transfer belt 52 moves from the reference position 52SP in the width direction by only the unit movement amount and the rotation amount of the rotating portion 57C around the rotation shaft 58 when the transfer belt 52 moves from the first position 52P1 or the second position 52P2 in the width direction by only the unit movement amount becomes small. That is, as the angle is smaller, a sensor (for example, the optical sensor 67) that acquires the physical amount may more accurately acquire the physical amount that changes due to the rotation of the rotating portion 57C. Thus, for example, the present disclosure may be implemented in an aspect of a modification illustrated in FIG. 11. The flat-surface shape of a coupling portion 57B of this modification is a V-shape. In the example illustrated in FIG. 11, a portion of the coupling portion 57B is located directly below the upper portion 52A. In the example illustrated in FIG. 11, when the transfer belt 52 is located at the reference position 52SP, an angle formed by a straight line connecting the contact portion 57C3 and the rotation shaft 58 in plan view and the transport direction A of the transfer belt 52 is substantially 0°.

One of the movement amount detection device 17A and the movement amount detection device 17B may be omitted from the image forming apparatus 10.

The image forming apparatus 10 may be provided with another movement amount detection device in addition to the movement amount detection device 17A and the movement amount detection device 17B.

The number of colors of images (toner images or ink images) formed on a formation target body (transfer belt 52 or recording paper P) need not be four. For example, the number of colors of images may be six.

For example, three or more image forming bodies may be arranged along the upper portion 52A. Similarly, three or more image forming bodies may be arranged along the lower portion 52B.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:
a belt to be transported;
an image forming body that forms an image on the belt or a recording medium that is transported by the belt;
a moving mechanism that moves the belt in a movement direction extending in a thickness direction of the belt;
a rotational member including a rotation shaft extending in the movement direction and a contact portion that is rotatable around the rotation shaft and that is in contact with a side surface of the belt regardless of a position of the belt in the movement direction;
an acquirer that acquires a physical amount that changes due to rotation of the contact portion around the rotation shaft when the belt moves in a width direction; and
a detector that detects a movement amount of the belt in the width direction based on the physical amount acquired by the acquirer.

2. The image forming apparatus according to claim 1, wherein the contact portion is a straight-line-shaped portion extending in a direction along the rotation shaft.

3. The image forming apparatus according to claim 2, wherein the contact portion is a round-surface-shaped portion.

4. The image forming apparatus according to claim 3,
wherein the rotational member includes a rotating portion that extends in the direction along the rotation shaft and that rotates around the rotation shaft, and
wherein the rotating portion includes:
a first plate-shaped portion,
a second plate-shaped portion connected to the first plate-shaped portion so as to intersect with the first plate-shaped portion when viewed along the rotation shaft, and
the contact portion that is the round-surface-shaped portion formed at a connecting portion between the first plate-shaped portion and the second plate-shaped portion.

5. The image forming apparatus according to claim 4, comprising:
an interlocking portion that is a body different from the rotational member and that rotates in association with rotation of the contact portion around the rotation shaft; and
the acquirer that acquires the physical amount that changes due to rotation of the interlocking portion.

6. The image forming apparatus according to claim 3,
wherein the rotational member includes:
a rotating portion that extends in the direction along the rotation shaft and that rotates around the rotation shaft, the rotating portion including one end portion and the other end portion, and
a coupling portion that couples the rotation shaft and the one end portion of the rotating portion, and
wherein an area of a cross section intersecting with the direction along the rotation shaft of a portion of the rotating portion excluding the other end portion of the rotating portion is larger than an area of a cross section intersecting with the direction along the rotation shaft of the other end portion of the rotating portion.

7. The image forming apparatus according to claim 6, comprising:
an interlocking portion that is a body different from the rotational member and that rotates in association with rotation of the contact portion around the rotation shaft; and
the acquirer that acquires the physical amount that changes due to rotation of the interlocking portion.

8. The image forming apparatus according to claim 3, comprising:
an interlocking portion that is a body different from the rotational member and that rotates in association with rotation of the contact portion around the rotation shaft; and
the acquirer that acquires the physical amount that changes due to rotation of the interlocking portion.

9. The image forming apparatus according to claim 2,
wherein the rotational member includes:
a rotating portion that extends in the direction along the rotation shaft and that rotates around the rotation shaft, the rotating portion including one end portion and the other end portion, and
a coupling portion that couples the rotation shaft and the one end portion of the rotating portion, and wherein an area of a cross section intersecting with the direction along the rotation shaft of a portion of the rotating portion excluding the other end portion of the rotating portion is larger than an area of a cross section intersecting with the direction along the rotation shaft of the other end portion of the rotating portion.

10. The image forming apparatus according to claim 9, comprising:

an interlocking portion that is a body different from the rotational member and that rotates in association with rotation of the contact portion around the rotation shaft; and the acquirer that acquires the physical amount that changes due to rotation of the interlocking portion.

11. The image forming apparatus according to claim 2, comprising:

an interlocking portion that is a body different from the rotational member and that rotates in association with rotation of the contact portion around the rotation shaft; and the acquirer that acquires the physical amount that changes due to rotation of the interlocking portion.

12. The image forming apparatus according to claim 11, comprising an urging member that applies a force to the interlocking portion in a direction in which the interlocking portion is brought into contact with the rotational member.

13. The image forming apparatus according to claim 1, wherein the rotational member includes:

a rotating portion that extends in a direction along the rotation shaft and that rotates around the rotation shaft, the rotating portion including one end portion and the other end portion, and a coupling portion that couples the rotation shaft and the one end portion of the rotating portion, and wherein an area of a cross section intersecting with the direction along the rotation shaft of a portion of the rotating portion excluding the other end portion of the rotating portion is larger than an area of a cross section intersecting with the direction along the rotation shaft of the other end portion of the rotating portion.

14. The image forming apparatus according to claim 13, comprising:

an interlocking portion that is a body different from the rotational member and that rotates in association with rotation of the contact portion around the rotation shaft; and the acquirer that acquires the physical amount that changes due to rotation of the interlocking portion.

15. The image forming apparatus according to claim 1, comprising:

an interlocking portion that is a body different from the rotational member and that rotates in association with rotation of the contact portion around the rotation shaft; and the acquirer that acquires the physical amount that changes due to rotation of the interlocking portion.

16. The image forming apparatus according to claim 15, comprising an urging member that applies a force to the interlocking portion in a direction in which the interlocking portion is brought into contact with the rotational member.

17. The image forming apparatus according to claim 1, comprising an urging member that applies a force to the contact portion in a direction in which the contact portion is brought into contact with the side surface of the belt.

18. A movement amount detection device comprising:

a rotational member including a rotation shaft and a contact portion that extends in a direction along the rotation shaft and that is rotatable around the rotation shaft;

an acquirer that acquires a physical amount that changes due to rotation of the contact portion when the contact portion rotates around the rotation shaft while being in contact with a side surface of a detected body that is transported in a direction intersecting with an extension direction of the rotation shaft and that is movable in a width direction of the detected body; and an interlocking portion that is a body different from the rotational member and that rotates in association with rotation of the contact portion around the rotation shaft; wherein the acquirer acquires the physical amount that changes due to rotation of the interlocking portion.

19. The movement amount detection device according to claim 18, wherein the contact portion is a straight-line-shaped portion extending in the direction along the rotation shaft.

* * * * *